US006799510B2

(12) United States Patent
Sandstrom

(10) Patent No.: US 6,799,510 B2
(45) Date of Patent: Oct. 5, 2004

(54) THIN-WALLED BRIDGE MANDREL

(75) Inventor: Van R. Sandstrom, Ann Arbor, MI (US)

(73) Assignee: New Hudson Corporation, New Hudson, MI (US)

( * ) Notice: Subject to any disclaimer, the term of this patent is extended or adjusted under 35 U.S.C. 154(b) by 226 days.

(21) Appl. No.: 10/139,115

(22) Filed: May 2, 2002

(65) Prior Publication Data

US 2003/0205155 A1 Nov. 6, 2003

(51) Int. Cl.[7] ..... B41F 13/10

(52) U.S. Cl. ..... 101/375; 492/48; 492/53; 492/54

(58) Field of Search ..... 101/375, 376, 101/479; 492/4, 50, 53, 54, 30, 28, 48

(56) References Cited

U.S. PATENT DOCUMENTS

| | | | | | |
|---|---|---|---|---|---|
| 4,903,597 | A | * | 2/1990 | Hoage | 101/401.1 |
| 4,949,445 | A | * | 8/1990 | Van Der Meulen | 492/15 |
| 5,351,615 | A | * | 10/1994 | Köbler et al. | 101/376 |
| 5,352,507 | A | * | 10/1994 | Bresson et al. | 428/245 |
| 5,544,584 | A | | 8/1996 | Thompson et al. | 101/401.1 |
| 5,706,731 | A | * | 1/1998 | Francille et al. | 101/375 |
| 5,782,181 | A | * | 7/1998 | Rossini | 101/175 |
| 5,860,360 | A | * | 1/1999 | Lane, III et al. | 101/376 |
| 5,904,095 | A | * | 5/1999 | Nelson | 101/375 |
| 6,377,772 | B1 | * | 4/2002 | Chowdry et al. | 492/48 |
| 6,467,409 | B2 | * | 10/2002 | Busshoff | 101/375 |
| 6,541,171 | B1 | * | 4/2003 | Chowdry et al. | 430/58.65 |
| 6,669,613 | B1 | * | 12/2003 | Van Denend | 492/49 |

FOREIGN PATENT DOCUMENTS

| | | | |
|---|---|---|---|
| WO | WO98/29259 | * | 7/1998 |

* cited by examiner

*Primary Examiner*—Eugene H. Eickholt
(74) *Attorney, Agent, or Firm*—Gifford, Krass, Groh, Sprinkle, Anderson & Citkowski, PC

(57) ABSTRACT

A lightweight, low-cost bridge mandrel applicable to the Flexographic printing process is adapted for mounting on the outer surface of a shaft or roller. The mandrel preferably includes a thin-walled, cylindrical metal tube having an inner surface, an outer surface, and two ends defining a length. An end cap is disposed at each end of the tube, each with a central bore to receive the shaft or roller. A polymeric layer is bonded directly or indirectly to the metal tube, thereby defining a precise, desired final diameter upon which to mount a printing sleeve. The metal tube is preferably steel, though aluminum and various metal or composite alloys may alternatively be used. A cavity is created between the outer surface of the shaft or roller and the inner surface of the metal tube, and at least one of the end caps may include a passageway from the cavity through the tube to the outer surface, such that the cavity may be pressurized to assist in installing and removing the outer sleeve, as is common practice in the Flexographic industry. The polymeric coating is preferably a hard polyurethane, though other materials may be used, including natural or synthetic rubber or other elastomers, or ABS, PVC, acrylics or other plastics or epoxy-based layers. In some cases, a fiber-reinforced layer may be disposed between the outer surface of the metal tube and the polymeric layer. At least some of the fibers may be oriented longitudinally with respect to the metal tube, or circumferentially, to enhance bending and/or hoop strength, respectively. The fiber-reinforced layer may include a type fiber glass or aramid fibers, or alternative materials, along with appropriate bonding resin.

44 Claims, 2 Drawing Sheets

THIN-WALLED BRIDGE MANDREL

FIELD OF THE INVENTION

This invention relates generally to the printing industry and, in particular, to a bridge mandrel combining an inner metal tube and outer polymeric surface.

BACKGROUND OF THE INVENTION

The Flexographic printing industry uses air-mounted thin sleeves to carry the printing plates in the press. Thicker sleeves, sometimes called "repeat builders," can be manufactured to varying thicknesses (annular dimension) to economically provide a larger printing circumference which defines the repeat length.

An extension of this approach is "sleeve-on-sleeve" technology, wherein an intermediate "bridge mandrel" is used to provide the annular dimension or diameter on which a conventional or thin plate image-carrying sleeve can be mounted.

Until very recently, all sleeves, repeat builders and bridge mandrels were mounted on mandrels through the use of air pressure to expand the sleeve onto the mandrel by introducing high-pressure air in the annular space between the sleeve I.D. and the mandrel O.D. A soft compressible material (i.e., closed-cell urethane foam) is typically used to accommodate the expansion of the base fiberglass sleeve. However, this "soft" mount arrangement causes quality and durability problems. New press designs are offering hydraulic, hard-mount mechanical systems to firmly and more accurately secure bridge mandrels in place; the thin sleeves or repeat builders can then be air mounted onto bridge mandrels.

Mechanical or "hard mount" bridge mandrels, particularly for print widths greater than 45", require a tubular design to provide the necessary stiffness (deflection) without excessive weight. The industry is currently using bridge mandrels made from carbon fiber tubes to provide sufficient stiffness with minimum weight, but at considerable cost. There is an outstanding need, therefore, for a bridge mandrel which meets the stiffness requirements of this industry, while being less expensive than carbon-fiber products.

SUMMARY OF THE INVENTION

While it is generally held that thin-walled steel tubes cannot be used for repeat builders such as bridge mandrels due to wall-thickness variations and the extreme difficulties associated with machining, this invention overcomes the problem by applying a coating or layer of hard elastomer, epoxy, polymer or other suitable material to the OD surface of a thin-walled steel tube and machining this material to the necessary tolerances. The coating is chosen for a relative ease of machining combined with a resistance to thermal transfer. As such, the invention is able to utilize roll-formed and welded tubes using thin gauge steel sheet which can be economically formed, welded and transported in small quantities. The less accurate O.D., ovality and straightness associated with the roll formed and welded process is acceptable when the precision tolerances of a bridge mandrel are machined in the polymer coating and not in the steel tube.

As with existing carbon-fiber and other bridge mandrel designs, the mandrel according to this invention is adapted for mounting on the outer surface of a shaft or roller of the type use in the Flexographic printing process. An end cap is disposed at each end of the tube, each end cap having a central bore to receive the shaft or roller. The outer layer to be machined is bonded directly or indirectly to the metal tube, thereby defining a precise, desired final diameter upon which to mount the printing sleeve.

Although in the preferred embodiment the thin-walled, cylindrical metal tube is a type of steel, aluminum and various metal or composite alloys may alternatively be used. A cavity is created between the outer surface of the shaft or roller and the inner surface of the metal tube, and at least one of the end caps preferably includes a passageway from the cavity through the tube to the outer surface, such that the cavity may be pressurized to assist in installing and removing the outer sleeve, as is common practice in the Flexo industry. To accommodate existing plates, the length of the mandrel may be 96 inches or less, with a circumference of perhaps 36 inches or less, and a wall thickness of 0.125 inches or less. However, these preferred dimensions are based upon current technology and are therefore subject to change in accordance with the invention as lengths and diameters increase, as anticipated.

The polymeric coating is preferably a hard polyurethane, though other materials may be used, including natural or synthetic rubber or other elastomers, or ABS, PVC, acrylics or other plastics or epoxy-based layers. In some cases, a fiber-reinforced layer may be disposed between the outer surface of the metal tube and the polymeric layer. At least some of the fibers may be oriented longitudinally with respect to the metal tube, or circumferentially, to enhance bending and/or hoop strength, respectively. The fiber-reinforced layer may include a type fiber glass or aramid fibers, or alternative materials, along with appropriate bonding resin.

DETAILED DESCRIPTION OF THE INVENTION

Figure 1:
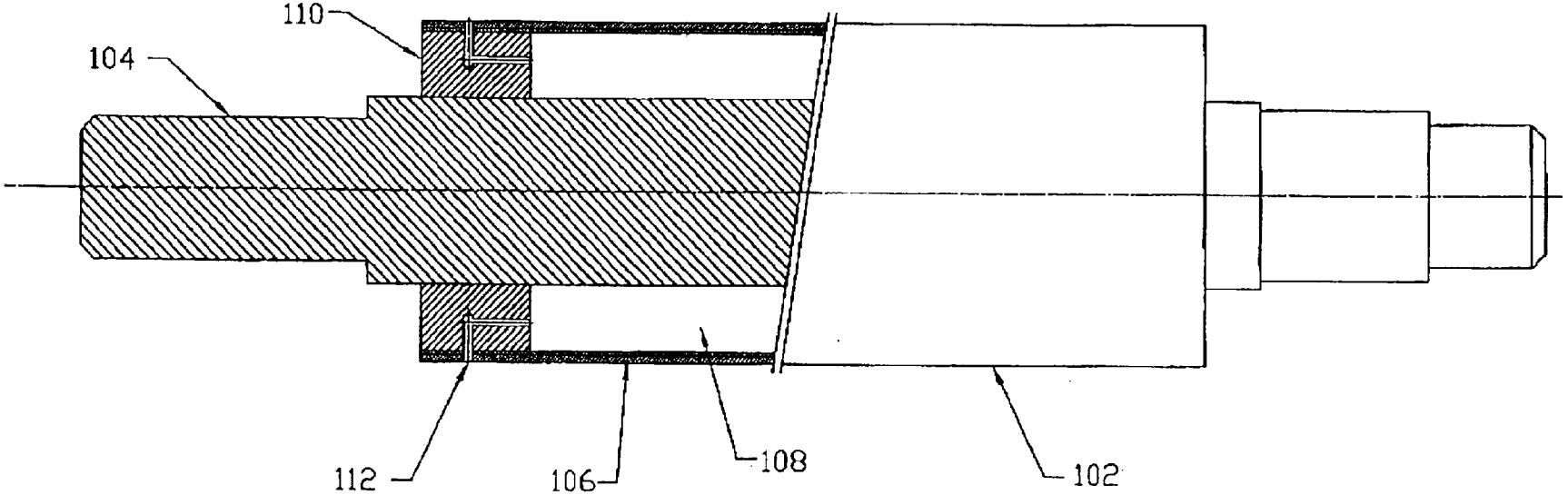
FIG. 1 is a drawing, in partial cross-section, of a thin-walled bridge mandrel constructed in accordance with this invention and installed on a cantilevered shaft of the type used in the flexographic printing process.

FIG. 1 is a drawing which shows a thin-walled bridge mandrel according to the invention in partial cross-section at 102, installed on a cantilevered shaft 104 of the type used in the flexographic printing process. The mandrel 102 is shown on a cantilevered shaft 104 because such a configuration is preferred in the industry, facilitating a rapid change of mandrels and rollers without having to detach one end of the rotating shaft. However, the invention is equally applicable to different and older-style configurations, wherein the inventive bridge mandrel would be placed onto a removable roller having both ends detachable.

Broadly, the bridge mandrel 102 includes a thin-walled cylindrical structure 106 discussed in further detail below, which is bonded to a pair of opposing end caps 110 having air channels 112 formed therethrough. The purpose of the air channels 112 is to permit pressurized air supplied through one or more ports in the shaft 104 to slightly expand an outer sleeve (not shown) placed over the mandrel 102 facilitate installation and removal. That is, with the cavity 108 formed between the inner surface of the thin-walled structure 106 and the outer surface of the shaft 104, pressurized typically in the range of 80–90 psi, as an outer sleeve is placed onto the mandrel, the air results in a thin interface of air between the two cylindrical structures, enabling the sleeve to be pushed onto the mandrel, at which time the air supply is removed causing a slight contraction of the sleeve, locking it onto the mandrel for use. An opposite process is used for removal.

Figure 2:
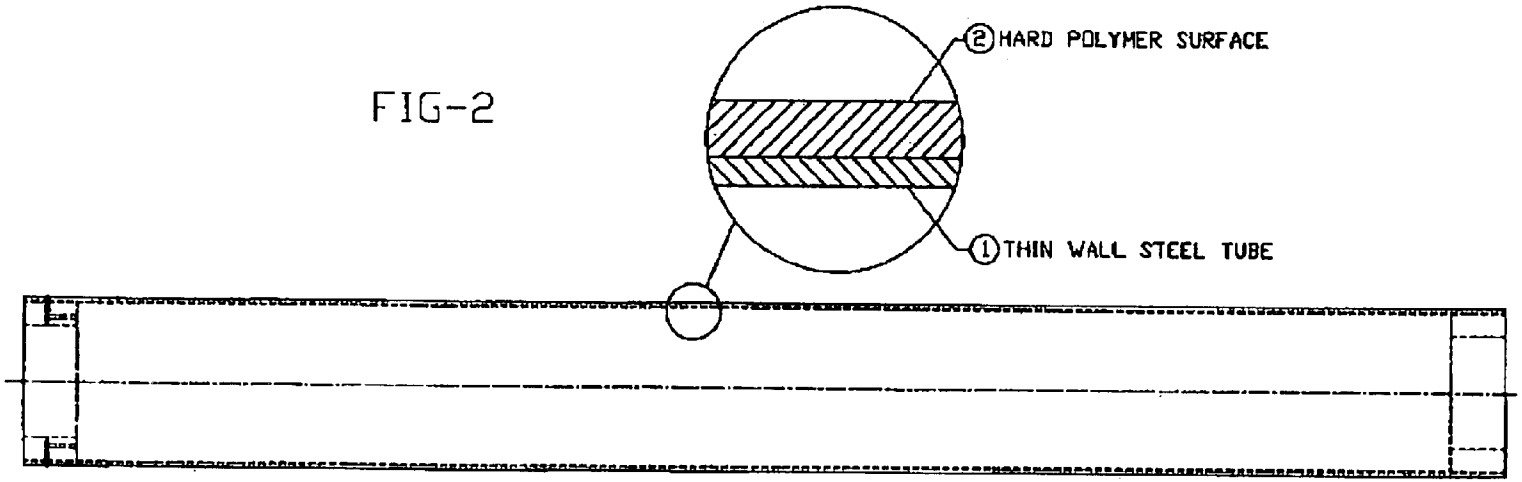
FIG. 2 is a drawing showing a preferred embodiment of a wall structure including a thin-walled steel tube and hard polymer outer surface.

FIG. 2A is a drawing of a mandrel constructed in accordance with the invention, providing details of the thin-walled structure. In this preferred embodiment, a hard polymer surface is placed over the thin-walled steel tube, thereby creating a strong, yet lightweight composite that can be easily machined to exacting tolerances. The thin walled steel tubing is preferably in the range of 0.39 to 0.152 inch, depending upon the length and diameter of the roller and perhaps other factors associated with use. It will be appreciated that dimensions outside of this preferred range may be used so long as desired structural properties such as high bending and hoop strength are achieved for a given application. While steel is preferred for its relative low cost and dimensional stability, other thin-walled materials may be used, such as aluminum, stainless steel and various alloys.

In the preferred embodiment, a hard polymer coating on the thin-walled inner tube is a non-compressible polyurethane having a preferred durometer in the range of 50–70 Shore D. Although a thickness somewhat greater than that of the inner wall is shown, again, thinner or thicker coatings may be used so long as the finished outer surface is hard, durable, abrasion-resistant and dimensionally stable for a given application. The advantage of polyurethane is that it generates a minimum of heat when machined, thereby transferring relatively little thermal energy during the machining operation to the underlying thin-walled tube so as not to undermine the dimensional stability. Again, however, alternative materials may be used for the outer surface, including different polymers, natural or synthetic "rubbers" or elastomers, epoxies, nylons, acrylics, and plastics, including ABS, PVC, and other suitable formulations.

Figure 3:
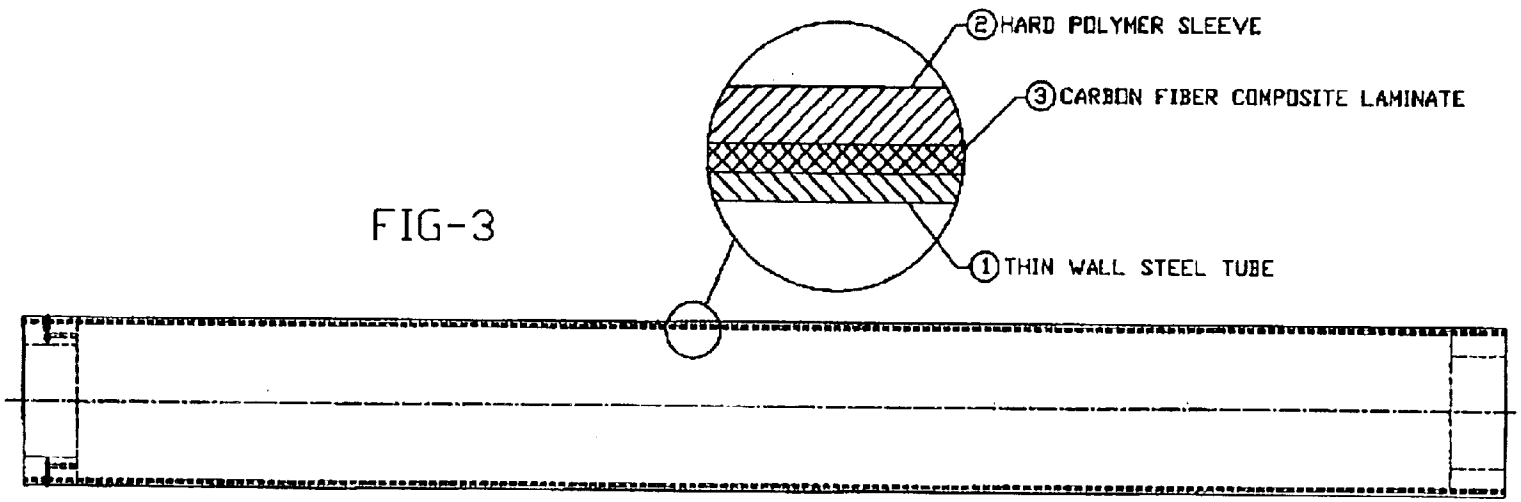
FIG. 3 is a drawing with a detailed view of a preferred alternative embodiment of the invention incorporating an intermediate fiber composite layer providing desirable properties in partial configurations.

Depending on the length and diameter of the bridge mandrel, it may be desirable to use an intermediate fiber-reinforced composite layer, as shown in FIG. 3. In such situations, a carbon fiber-resin laminate is preferred, though other fiberglass, E glass fibers, aramid fibers (i.e., Kevlar) each with hypoxy or polyester bonding resin may alternatively be used. The desired properties of the fiber-reinforced composite layer offers such things as vibration dampening with a low weight to stiffness ratio. Though dimensionally stable, the layer allows the engineering of structural properties such as an isotropic bending vs. hoop strength. That is, for a high resistance to bending, the fibers of the reinforcement may be oriented longitudinally with respect to the axis of the mandrel, whereas to enhance hoop strength, fibers running circumferentially may be more desirable. As a practical example, as the various sleeves used in the flexographic process may range from a width of a couple feet to six feet, or perhaps more, with circumferences in range of a few inches to a couple feet or more, thereby determining the repetition of the pattern, it may be desirable to have the fibers oriented to enhance hoop strength at large widths and small diameters, whereas, with larger diameters and perhaps a shorter length, it may be more desirable to orient the fibers to counteract bending.

As a further alternative option, a layer of wound or chopped carbon or glass fiber impregnated tape (with appropriate resins) may be applied to the OD of the thin-walled inner tube prior to the application of the surface coating, be it urethane, epoxy or polymer. In addition to adding hoop and bending strength to the assembly, the fiber should impart additional, favorable vibration dampening effects. As yet a further different option, chopped carbon or glass fiber may be added directly to the urethane, epoxy or other polymeric surface coating, thereby adding strength and favorable dampening characteristics to the assembly.

I claim:

1. A bridge mandrel adapted for mounting on a shaft or roller having an outer surface, the mandrel comprising:

a thin-walled, cylindrical metal tube having an inner surface, an outer surface, and two ends defining a length;

a pair of end caps, one at each end of the metal tube, each end cap having an outer surface adjacent the inner surface of the tube, and a central bore to receive the shaft or roller; and a machined polymeric layer outside the metal tube defining a precise, desired final diameter.

2. The bridge mandrel according to claim 1, wherein the thin-walled, cylindrical metal tube is a type of steel, aluminum, or a metal alloy.

3. The bridge mandrel according to claim 1, wherein:

a cavity is created between the outer surface of the shaft or roller and the inner surface of the metal tube; and at least one of the end caps includes a passageway from the cavity through the tube to the outer surface thereof, such that the cavity may be pressurized to assist in installing and removing an outer sleeve onto, and off of, the tube.

4. The bridge mandrel according to claim 1, wherein the polymeric layer includes one or more of the following:

polyurethane, natural or synthetic rubber or other elastomer, acrylic, ABS, PVC or other plastic, and an epoxy-based layer.

5. The bridge mandrel according to claim 1, wherein the wall thickness of the metal tube is 0.125 inches or less.

6. The bridge mandrel according to claim 1, wherein the length of the cylindrical metal tube is 96 inches or less.

7. The bridge mandrel according to claim 1, wherein the final circumference is 36 inches or less.

8. The bridge mandrel according to claim 1, further including a fiber-reinforced layer disposed between the outer surface of the metal tube and the polymeric layer.

9. The bridge mandrel according to claim 8, wherein at least some of the fibers are oriented longitudinally with respect to the metal tube.

10. The bridge mandrel according to claim 8, wherein at least some of the fibers are oriented circumferentially with respect to the metal tube.

11. The bridge mandrel according to claim 12, wherein the fiber-reinforced layer includes a type fiber glass or aramid fibers and appropriate bonding resin.

12. The bridge mandrel according to claim 1, further including a layer of wound or chopped carbon or glass fiber impregnated tape and appropriate resin disposed between the outer surface of the metal tube and the polymeric layer.

13. The bridge mandrel according to claim 1, further including an amount of chopped carbon or glass fiber added to the polymeric layer prior to the curing thereof.

14. A bridge mandrel adapted for mounting on a shaft or roller having an outer surface, the mandrel comprising:

a thin-walled, cylindrical metal tube having an inner surface, an outer surface, and two ends defining a length;

a pair of end caps, one at each end of the metal tube, each end cap having an outer surface adjacent the inner surface of the tube, and a central bore to receive the shaft or roller, such that a cavity is created between the outer surface of the shaft or roller and the inner surface of the metal tube;

at least one of the end caps further including a passageway from the cavity through the tube to the outer surface thereof, such that the cavity may be pressurized to assist in installing and removing an outer sleeve onto, and off of, the tube; and a machined polymeric layer outside the metal tube defining a precise, desired final diameter.

15. The bridge mandrel according to claim 14, wherein the thin-walled, cylindrical metal tube is a type of steel, aluminum, or a metal alloy.

16. The bridge mandrel according to claim 14, wherein the polymeric layer includes one or more of the following:

polyurethane, natural or synthetic rubber or other elastomer, a acrylic, ABS, PVC or other plastic, and an epoxy-based layer.

17. The bridge mandrel according to claim 14, wherein the wall thickness of the metal tube is 0.125 inches or less.

18. The bridge mandrel according to claim 14, wherein the length of the cylindrical metal tube is 96 inches or less.

19. The bridge mandrel according to claim 14, wherein the final circumference is 36 inches or less.

20. The bridge mandrel according to claim 14, further including a fiber-reinforced layer disposed between the outer surface of the metal tube and the polymeric layer.

21. The bridge mandrel according to claim 20, wherein at least some of the fibers are oriented longitudinally with respect to the metal tube.

22. The bridge mandrel according to claim 20, wherein at least some of the fibers are oriented circumferentially with respect to the metal tube.

23. The bridge mandrel according to claim 20, wherein the fiber-reinforced layer includes a type fiber glass or aramid fibers and appropriate bonding resin.

24. The bridge mandrel according to claim 14, further including a layer of wound or chopped carbon or glass fiber impregnated tape and appropriate resin disposed between the outer surface of the metal tube and the polymeric layer.

25. The bridge mandrel according to claim 14, further including an amount of chopped carbon or glass fiber added to the polymeric layer prior to the curing thereof.

26. A bridge mandrel adapted for mounting on a shaft or roller having an outer surface, the mandrel comprising:

a thin-walled, cylindrical metal tube having an inner surface, an outer surface, and two ends defining a length;

a pair of end caps, one at each end of the metal tube, each end cap having an outer surface adjacent the inner surface of the tube, and a central bore to receive the shaft or roller;

a fiber-reinforced layer covering the outer surface of the metal tube; and a polymeric layer covering the fiber-reinforced layer defining a precise, desired final diameter.

27. The bridge mandrel according to claim 26, wherein the thin-walled, cylindrical metal tube is a type of steel, aluminum, or a metal alloy.

28. The bridge mandrel according to claim 26, wherein:

a cavity is created between the outer surface of the shaft or roller and the inner surface of the metal tube; and at least one of the end caps includes a passageway from the cavity through the tube to the outer surface thereof, such that the cavity may be pressurized to assist in installing and removing an outer sleeve onto, and off of, the tube.

29. The bridge mandrel according to claim 26, wherein the polymeric layer includes one or more of the following:

polyurethane, natural or synthetic rubber or other elastomer, acrylic, ABS, PVC or other plastic, and an epoxy-based layer.

30. The bridge mandrel according to claim 26, wherein the wall thickness of the metal tube is 0.125 inches or less.

31. The bridge mandrel according to claim 26, wherein the length of the cylindrical metal tube is 96 inches or less.

32. The bridge mandrel according to claim 26, wherein the final circumference is 36 inches or less.

33. The bridge mandrel according to claim 26, wherein at least some of the fibers are oriented longitudinally with respect to the metal tube.

34. The bridge mandrel according to claim 26, wherein at least some of the fibers are oriented circumferentially with respect to the metal tube.

35. The bridge mandrel according to claim 26, wherein the fiber-reinforced layer includes a type fiber glass or aramid fibers and appropriate bonding resin.

36. The bridge mandrel according to claim 26, further including a layer of wound or chopped carbon or glass fiber impregnated tape and appropriate resin disposed between the outer surface of the metal tube and the polymeric layer.

37. The bridge mandrel according to claim 26, further including an amount of chopped carbon or glass fiber added to the polymeric layer prior to the curing thereof.

38. A bridge mandrel adapted for mounting on a shaft or roller having an outer surface, the mandrel comprising:

a steel tube having an inner surface and an outer surface defining a wall thickness of 0.125 inches or less, and two ends defining a length of 96 inches or less;

a pair of end caps, one at each end of the steel tube, each end cap having an outer surface adjacent the inner surface of the tube, and a central bore to receive the shaft or roller, such that a cavity is created between the outer surface of the shaft or roller and the inner surface of the metal tube;

at least one of the end caps further including a passageway from the cavity through the tube to the outer surface thereof, such that the cavity may be pressurized to assist in installing and removing an outer sleeve onto, and off of, the tube; and a hard polyurethane layer outside the metal tube machined to achieve a precise final circumference of 36 inches or less.

39. The bridge mandrel according to claim 38, further including a fiber-reinforced layer disposed between the outer surface of the steel tube and the polyurethane layer.

40. The bridge mandrel according to claim 39, wherein at least some of the fibers are oriented longitudinally with respect to the steel tube.

41. The bridge mandrel according to claim 39, wherein at least some of the fibers are oriented circumferentially with respect to the steel tube.

42. The bridge mandrel according to claim 39, wherein the fiber-reinforced layer includes a type fiber glass or aramid fibers and appropriate bonding resin.

43. The bridge mandrel according to claim 38, further including a layer of wound or chopped carbon or glass fiber impregnated tape and appropriate resin disposed between the outer surface of the steel tube and the polyurethane layer.

44. The bridge mandrel according to claim 38, further including an amount of chopped carbon or glass fiber added to the polyurethane layer prior to the curing thereof.

* * * * *